US006612820B1

(12) United States Patent
Staat et al.

(10) Patent No.: US 6,612,820 B1
(45) Date of Patent: Sep. 2, 2003

(54) SCREW COMPRESSOR HAVING SEALED LOW AND HIGH PRESSURE BEARING CHAMBERS

(76) Inventors: David Garrett Staat, 55 N. Cooperknoll Cir., The Woodlands, TX (US) 77381; Rinaldo Divalerio, 16050 Mesa Verde Dr., Houston, TX (US) 77059

( * ) Notice: Subject to any disclaimer, the term of this patent is extended or adjusted under 35 U.S.C. 154(b) by 0 days.

(21) Appl. No.: 09/869,442

(22) PCT Filed: Jan. 11, 2000

(86) PCT No.: PCT/US00/00659

§ 371 (c)(1),
(2), (4) Date: Jun. 26, 2001

(87) PCT Pub. No.: WO00/42322

PCT Pub. Date: Jul. 20, 2000

Related U.S. Application Data

(60) Provisional application No. 60/115,371, filed on Jan. 11, 1999.

(51) Int. Cl.[7] ..... F04C 18/16; F04C 27/00; F04C 29/02

(52) U.S. Cl. ..... 418/1; 418/87; 418/97; 418/104; 418/201.1; 418/DIG. 1

(58) Field of Search ..... 418/1, 87, 88, 418/97, 100, 104, 201.1, DIG. 1

(56) References Cited

U.S. PATENT DOCUMENTS

| | | | | |
|---|---|---|---|---|
| 3,073,513 A | | 1/1963 | Bailey et al. | 418/201.1 |
| 3,975,123 A | | 8/1976 | Schibbye et al. | 418/97 |
| 4,993,930 A | * | 2/1991 | Uchida et al. | 418/104 |
| 5,037,282 A | * | 8/1991 | Englund | 418/201.1 |

FOREIGN PATENT DOCUMENTS

| | | | | |
|---|---|---|---|---|
| DE | 733959 | | 4/1943 | |
| EP | 0 775 812 | | 5/1997 | |
| EP | 0 859 154 | | 8/1998 | |
| FR | 2 242 579 | | 3/1975 | |
| FR | 2569780 | * | 3/1986 | 418/201 |
| JP | 62-261689 | * | 11/1987 | 418/201.1 |
| JP | 06 346822 | | 12/1994 | |
| RU | 1679059 | * | 9/1991 | 418/87 |

* cited by examiner

*Primary Examiner*—John J. Vrablik

(57) ABSTRACT

A method and apparatus for compressing process fluids in a working chamber having a male and a female rotor, each supported by shafts in a first and a second bearing chamber maintained at low and high pressures at least equal to 90% of the low and high pressures in the working chamber, respectively. The compressor has a first pressurized lubrication reservoir connected to the first bearing chamber and a second pressurized lubrication reservoir connected to the second bearing chamber. The fluids in the working chamber, which may be corrosive, are kept out of the fluids in the bearing and gear chambers by labyrinth seals on the rotor shafts, the seals having grooves in communication with a pressurized buffer gas system. Leakage of buffer gas from the seals enters the bearing chambers and reservoirs, and is released from them at flow rates to control the bearing chamber pressures.

19 Claims, 4 Drawing Sheets

SCREW COMPRESSOR HAVING SEALED LOW AND HIGH PRESSURE BEARING CHAMBERS

This application claims the benefit of Provisional application No. 60/115,371, filed Jan. 11, 1999.

FIELD OF INVENTION

This invention relates generally to rotary compressors, and more particularly to rotary compressors of the positive displacement type including two or more rotors or screws disposed within a housing, supported by bearings, and formed with inter-engaging helical lobes and grooves.

BACKGROUND

It is disclosed in prior art of rotary compressors, that one rotor is driven and it in turn drives the other rotor through a gear system or directly without gears. The rotors do not contact each other or the housing, but have small clearances between tips on the lobes, mating surfaces on the rotors, and the inner surface of the housing. The housing is provided with an entrance port at one end and a discharge port at the opposed end, the discharge port proportioned to cause the pressure of the gas being compressed to be raised within the compressor before the gas is discharged. The compressor has a working chamber where a process gas is compressed and in some cases a liquid, such as oil, is injected into the chamber to lubricate the intermeshing rotors, seal the clearances between the rotors and casing, and to cool the gas being compressed. In the case where one rotor directly drives the other, the injected liquid transmits the driving force from one rotor to the other. Downstream of the compressor, this oil may be recovered by passing through a separator that allows the oil to be separated from the gaseous fluid. Such a compressor that utilizes a lubricating system for the rotors for sealing and cooling, and in most cases, force transmittal, is called a flooded screw compressor. It can achieve higher compression ratios than so-called dry compressors that omit a sealing lubricant in the working chamber and rely on a precision mating of rotors and precision gears to maintain a very close fit between moving parts for sealing (controlled leakage). It is desirable to provide systems where the gears and bearings supporting the rotors are also lubricated with a separate oil supply to a plurality of bearing and gear chambers that are separated from the working chamber by seals.

The following disclosure may be relevant to various aspects of the present invention and may be briefly summarized as follows:

U.S. Pat. No. 3,073,513 to Bailey teaches a flooded screw compressor that utilizes a separate pressurized oil supply tank and pump to provide oil for the working chamber. A certain viscosity oil is required to achieve the desired sealing with given clearances, volumetric ratios of oil and gas, and speeds of operation. The outlet from the compressor includes a separator where the oil is separated and recirculated to the pressurized tank. The bearings and gears are lubricated by a separate oil supply that comprises a ventilated tank and a pump that supplies oil to the bearings from which it drains back to the ventilated tank. It is suggested that labyrinth seals can be used at both ends of the rotors between the two oil systems.

However, a problem exists in that the seals separating the two oil systems, or separating one oil system from a process fluid, are either expensive to manufacture and maintain to provide leak proof seals or they are inexpensive and simple to maintain, but allow leakage between the working chamber and the gears and bearings. In the latter case, where leakage occurs, there is a problem when the process fluid in the working chamber is corrosive or forms a corrosive mixture when contacting the oil. Leakage of the oil, if present, and process fluids from the working chamber into the bearings and gears causes accelerated corrosion and premature failure of the bearings and gears. The labyrinth seals suggested by Bailey typically operate with some clearance and thus, some degree of leakage is to be expected. In this case, and especially at the high pressure end, some leakage of process fluids and working chamber lubricant would be expected to leak into the bearings and would be recirculated to all bearings and gears. When the process gas is highly corrosive, even a small amount of such leakage can be detrimental to the bearings and will considerably shorten the life of the bearings. A problem occurs because the process must be shut down and the bearings replaced before the wear of the bearings causes excessive variation in the clearance between rotors that may result in severe damage to the compressor. Frequent process shutdowns are expensive and decrease productivity.

SUMMARY OF THE INVENTION

Briefly stated, and in accordance with one aspect of the present invention, there is provided method for lubricating and sealing bearings and gears associated with a plurality of rotors of a screw compressor and isolating a process fluid to be compressed from a lubricant for the bearings and gears, the screw compressor having the process fluid and the rotors in a working chamber, the rotors having shafts supported by the bearings, the bearings contained in a plurality of bearing chambers, the shafts passing from the working chamber to the bearings in the bearing chambers, the working chamber having a low pressure inlet end and a high pressure outlet end for the compressible fluid, comprising: providing a low bearing chamber pressure to a first bearing chamber adjacent the low pressure inlet end of the working chamber, the low bearing chamber pressure at least equal to about 90% of the pressure at the low pressure inlet end of the working chamber; providing a high bearing chamber pressure to a second bearing chamber adjacent the high pressure outlet end of the working chamber, the high bearing chamber pressure at least equal to about 90% of the average pressure at the high pressure outlet end of the working chamber;

pumping oil to the bearings in the plurality of bearing chambers under pressure;

sealing the first and second bearing chambers from the working chamber by seals having a bore around each rotor shaft, the seals comprising a body having a first end adjacent the working chamber and a second end adjacent a bearing chamber and an inner groove in the bore intermediate to the ends, the inner groove of each seal connected to a source of buffer gas; providing a buffer gas to the seals adjacent the first bearing chamber, the buffer gas having a low pressure adjacent the groove greater than the low bearing chamber pressure, a portion of the low pressure buffer gas entering the first bearing chamber; providing a buffer gas to the seals adjacent the second bearing chamber, the buffer gas having a high pressure adjacent the groove greater than the high bearing chamber pressure, a portion of the high pressure buffer gas entering the second bearing chamber;

releasing the oil in the first bearing chamber and the portion of the low pressure buffer gas from the first bearing chamber to maintain the low bearing chamber pressure; and releasing the oil in the second bearing chamber and the portion of the high pressure buffer gas from the second bearing chamber to maintain the high bearing chamber pressure.

Pursuant to another aspect of the present invention there is provided a method for lubricating and sealing the bearings and gears associated with a plurality of rotors of a screw compressor and isolating a process fluid to be compressed from a lubricant for the bearings and gears, the compressor having a process fluid and the rotors in a working chamber, the rotors having shafts supported by the bearings, the bearings contained in a plurality of bearing chambers, the shafts passing from the working chamber to the bearings in the bearing chambers, the working chamber having a low pressure inlet end and a high pressure outlet end for the compressible fluid, comprising: providing a first bearing chamber adjacent the low pressure inlet end of the working chamber; providing a second bearing chamber adjacent the high pressure outlet end of the working chamber; pumping oil to the bearings in the plurality of bearing chambers under pressure; sealing the first and second bearing chambers from the working chamber by seals having a bore around each rotor shaft, the seals comprising a body having a first end adjacent the working chamber and a second end adjacent a bearing chamber and an inner groove in the bore intermediate to the ends, the inner groove of each seal connected to a source of buffer gas; providing a low pressure buffer gas at a first predetermined flow rate to the seals adjacent the first bearing chamber, a first portion of the low pressure buffer gas entering the first bearing chamber; providing a high pressure buffer gas at a second predetermined flow rate to the seals adjacent the second bearing chamber, a first portion of the high pressure buffer gas entering the second bearing chamber; releasing the oil in the first bearing chamber and the first portion of the low pressure buffer gas from the first bearing chamber, and restricting the flow of released low pressure buffer gas to a rate less than the first predetermined rate to develop a low pressure in the first bearing chamber and force a second portion of low pressure buffer gas to enter the working chamber; and releasing the oil in the second bearing chamber and the first portion of the high pressure buffer gas from the second bearing chamber, and restricting the flow of released high pressure buffer gas to a rate less than the second predetermined rate to develop a high pressure in the second bearing chamber and force a second portion of high pressure buffer gas to enter the working chamber.

Pursuant to another aspect of the present invention, there is provided an apparatus for lubricating and sealing the bearings and gears associated with a plurality of rotors of a screw compressor and isolating a process fluid to be compressed from a lubricant for the bearings and gears, the compressor having the process fluid and the rotors in a working chamber, the rotors having shafts supported by the bearings, the bearings contained in a plurality of bearing chambers, the shafts passing from the working chamber to the bearings in the bearing chambers, the working chamber having a low pressure inlet end and a high pressure outlet end for the compressible fluid, comprising: a first bearing chamber adjacent the low pressure inlet end of the working chamber; means for providing a low bearing chamber pressure to the first bearing chamber, the low bearing chamber pressure at least equal to about 90% of the pressure at the low pressure inlet end of the working chamber; a second bearing chamber adjacent the high pressure outlet end of the working chamber; means for providing a high bearing chamber pressure to the second bearing chamber, the high bearing chamber pressure at least equal to about 90% of the average pressure at the high pressure outlet end of the working chamber; a plurality of seals adjacent each bearing chamber and at each rotor shaft for sealing the first and second bearing chambers from the working chamber, the seals having a bore around each rotor shaft, the seals comprising: a body having a first end adjacent the working chamber; and a second end adjacent a bearing chamber and an inner groove in the bore intermediate to the ends; a source of pressurized buffer gas connected to the inner groove of each seal; a first pressure control means between the source and the seals of the first bearing chamber to provide a low buffer gas pressure greater than the low bearing chamber pressure to the groove in the seals in the first bearing chamber wherein a portion of low pressure buffer gas passes into the first bearing chamber; and a second pressure control means between the source and the seals of the second bearing chamber to provide a high buffer gas pressure greater than the high bearing chamber pressure to the groove in the seals in the second bearing chamber wherein a portion of high pressure buffer gas passes into the second bearing chamber.

Pursuant to another aspect of the invention, there is provided an apparatus for lubricating and sealing the bearings and gears associated with a plurality of rotors of a screw compressor and isolating a fluid to be compressed from the bearing and gear lubricant, the compressor having a process fluid and the rotors in a working chamber, the rotors having shafts supported by the bearings, the bearings contained in a plurality of bearing chambers, the shafts passing from the working chamber to the bearings in the bearing chambers, the working chamber having a low pressure inlet end and a high pressure outlet end for the compressible fluid, comprising: a first bearing chamber adjacent the low pressure inlet end of the working chamber; a second bearing chamber adjacent the high pressure outlet end of the working chamber; a plurality of seals adjacent each bearing chamber and at each rotor shaft for sealing the first and second bearing chambers from the working chamber, the seals having a bore around each rotor shaft, the seals comprising a body having a first end adjacent the working chamber and a second end adjacent a bearing chamber and an inner groove in the bore intermediate to the ends; a source of pressurized buffer gas connected to the inner groove of each seal; a first flow control means between the source and the seals of the first bearing chamber providing a predetermined flow of low pressure buffer gas to the groove in the seals in the first bearing chamber wherein a portion of low pressure buffer gas passes into the first bearing chamber; a second flow control means between the source and the seals of the second bearing chamber to provide a predetermined flow of high pressure buffer gas to the groove in the seals in the second bearing chamber wherein a portion of high pressure buffer gas passes into the second bearing chamber; a third flow control means providing a flow of low pressure buffer gas from the first bearing chamber at a rate less than the predetermined flow of low pressure buffer gas; and a fourth flow control means providing a flow of high pressure buffer gas from the second bearing chamber at a rate less than the predetermined flow of high pressure buffer gas.

BRIEF DESCRIPTION OF THE FIGURES

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 1B:
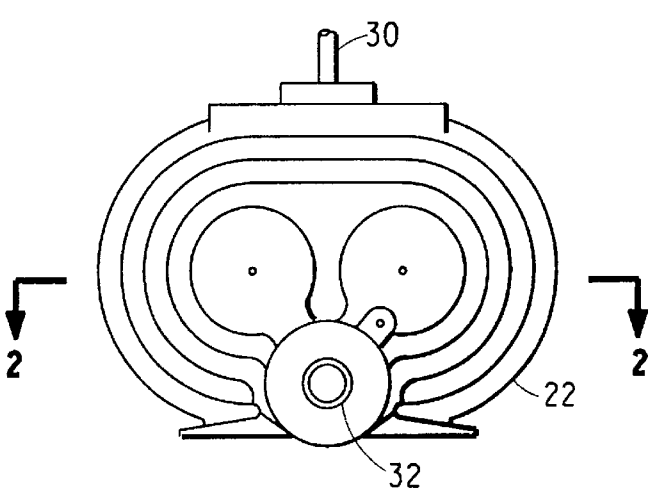
FIGS. 1A and 1B show a side elevation and end elevation of a screw compressor.
Figure 1A:
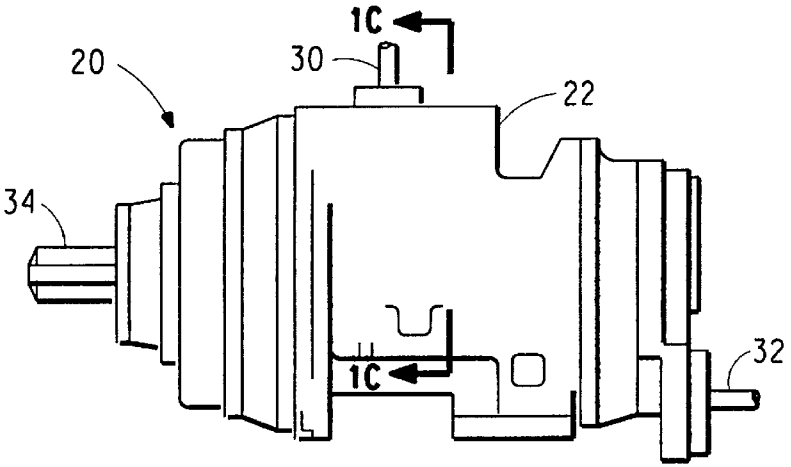
Figure 1C:
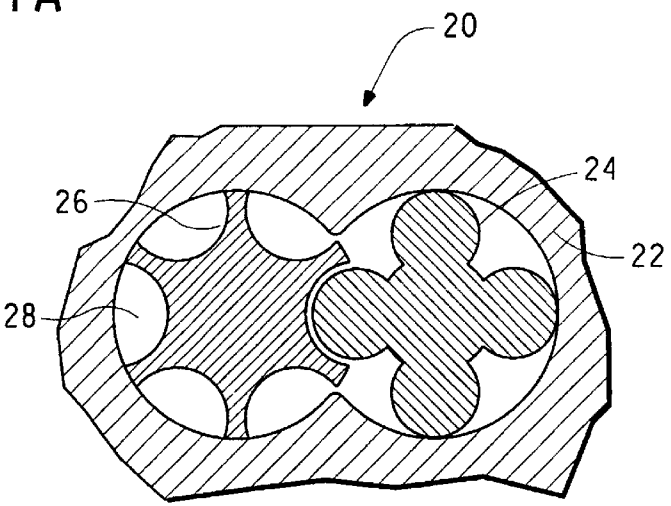
FIG. 1C shows a partial section view 1C—1C taken through the compressor of FIG. 1A showing the inter-engaging lobes of the rotors.

FIGS. 1A, 1B, and 1C show a rotary compressor 20 comprising a housing 22 containing at least a male rotor 24 and at least a female rotor 26 in a working chamber 28 (shown in FIG. 1C which is a partial section view 1C—1C taken from FIG. 1A), and a compressible process fluid inlet 30 and a compressed process fluid outlet 32. The male rotor is driven via a drive shaft 34 that would be attached to a source of rotary, motion (not shown), such as an electrical, steam powered, hydraulic, or internal combustion motor or the like. The process fluid inlet 30, although shown positioned at the side of the rotors, is in fluid communication with passages within the housing that direct the process fluid to the left end of the rotors as shown in FIG. 1A. The process fluid passes along the length of the rotors from left to right and is compressed between the rotors and against the right end of the working chamber before being directed to and expelled through the outlet 32. Such compressors are known in the art and no further explanation of their compressing operation is believed to be required.

Figure 2:
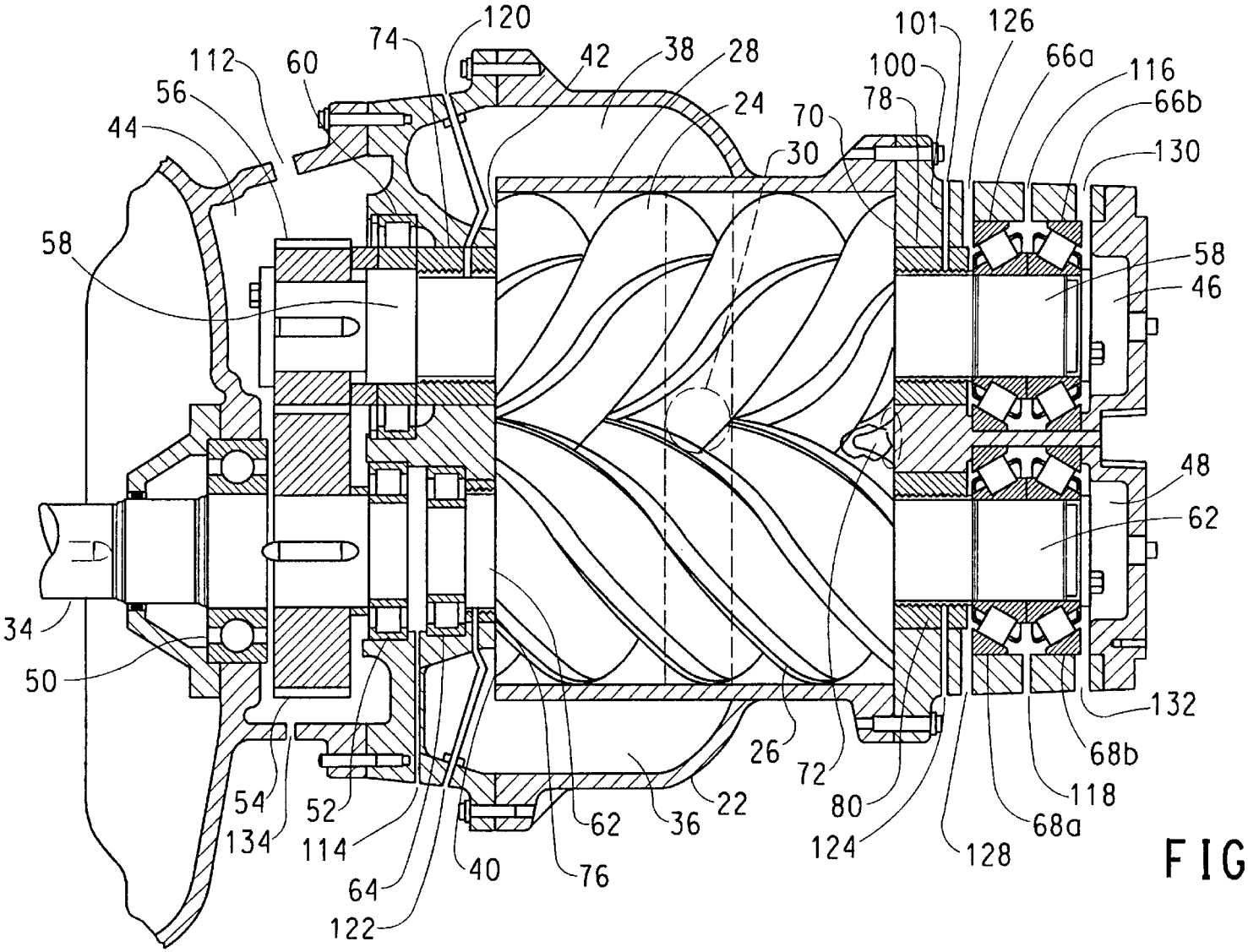
FIG. 2 shows a section view 2—2 taken through the rotor axes of the compressor of FIG. 1B showing labyrinth seals on the rotor shafts and passages for bearing seal lubricant and buffer gas.

FIG. 2 is section view 2—2 taken from FIG. 1B and shows further aspects of the rotary compressor. A portion of the housing at the drive shaft end has been cut away for clarity. Passages 36 and 38 connect the inlet 30 to the inlet end 40 of the female rotor 26 and to the inlet end 42 of the male rotor 24, respectively. The housing 22, in addition to the working chamber 28, further includes a plurality of bearing chambers, such as bearing and gear chamber 44, bearing chamber 46, and bearing chamber 48. Within bearing and gear chamber 44 are ball bearing 50 and roller bearing 52 that support drive shaft 34 and an attached drive gear 54. Drive gear 54 meshes with a pinion gear 56 on rotor shaft 58 of male rotor 24. Roller bearing 60 supports the gear end of rotor shaft 58. Rotor shaft 62 of female rotor 26 is supported by roller bearing 64. Roller bearings 60 and 64 are also within bearing and gear chamber 44.

At the outlet end of male rotor 24, the rotor shaft 58 is supported by a pair of angled roller bearings 66*a* and 66*b* which are located in bearing chamber 46. At the outlet end of female rotor 26, the rotor shaft 62 is supported by a pair of angled roller bearings 68*a* and 68*b* which are located in bearing chamber 48. The angled roller bearings in addition to supporting radial loads take all of the axial load on the respective shafts to thereby accurately position the rotors axially in the housing. All the aforementioned bearings are held to the shafts by conventional means and are supported and positioned by housing 22 and are held in place in the housing by conventional means. At the outlet end 70 of the working chamber 28 can be seen a triangular shaped opening 72 at least partly in the sidewall of the working chamber, which opening is in fluid communication with the outlet 32 (shown in FIGS. 1A and 1B).

Between the bearing 60 in bearing and gear chamber 44 and the working chamber 28 is a labyrinth seal 74 mounted in housing 22 and surrounding male rotor shaft 58. Between bearing 64 in bearing and gear chamber 44 and the working chamber 28 is a labyrinth seal 76 mounted in housing 22 and surrounding female rotor shaft 62. Between the bearing 66*a* in bearing chamber 46 and the working chamber 28 is a labyrinth seal 78 mounted in housing 22 and surrounding male rotor shaft 58. Between bearing 68*a* in bearing chamber 48 and the working chamber 28 is a labyrinth seal 80 mounted in housing 22 and surrounding female rotor shaft 62. Labyrinth seals 74 and 76 are intended to inhibit the flow of lubricating fluid from bearing and gear chamber 44 into working chamber 28 and inhibit the flow of process fluid and any rotor lubricating and sealing fluid from working chamber 28 into bearing and gear chamber 44. Labyrinth seal 78 is intended to inhibit the flow of lubricating fluid from bearing chamber 46 into working chamber 28 and inhibit the flow of process fluid and any rotor lubricating and sealing fluid from working chamber 28 into bearing chamber 46. Labyrinth seal 80 is intended to inhibit the flow of lubricating fluid from bearing chamber 48 into working chamber 28 and inhibit the flow of process fluid and any rotor lubricating and sealing fluid from working chamber 28 into bearing chamber 48.

Figure 3:
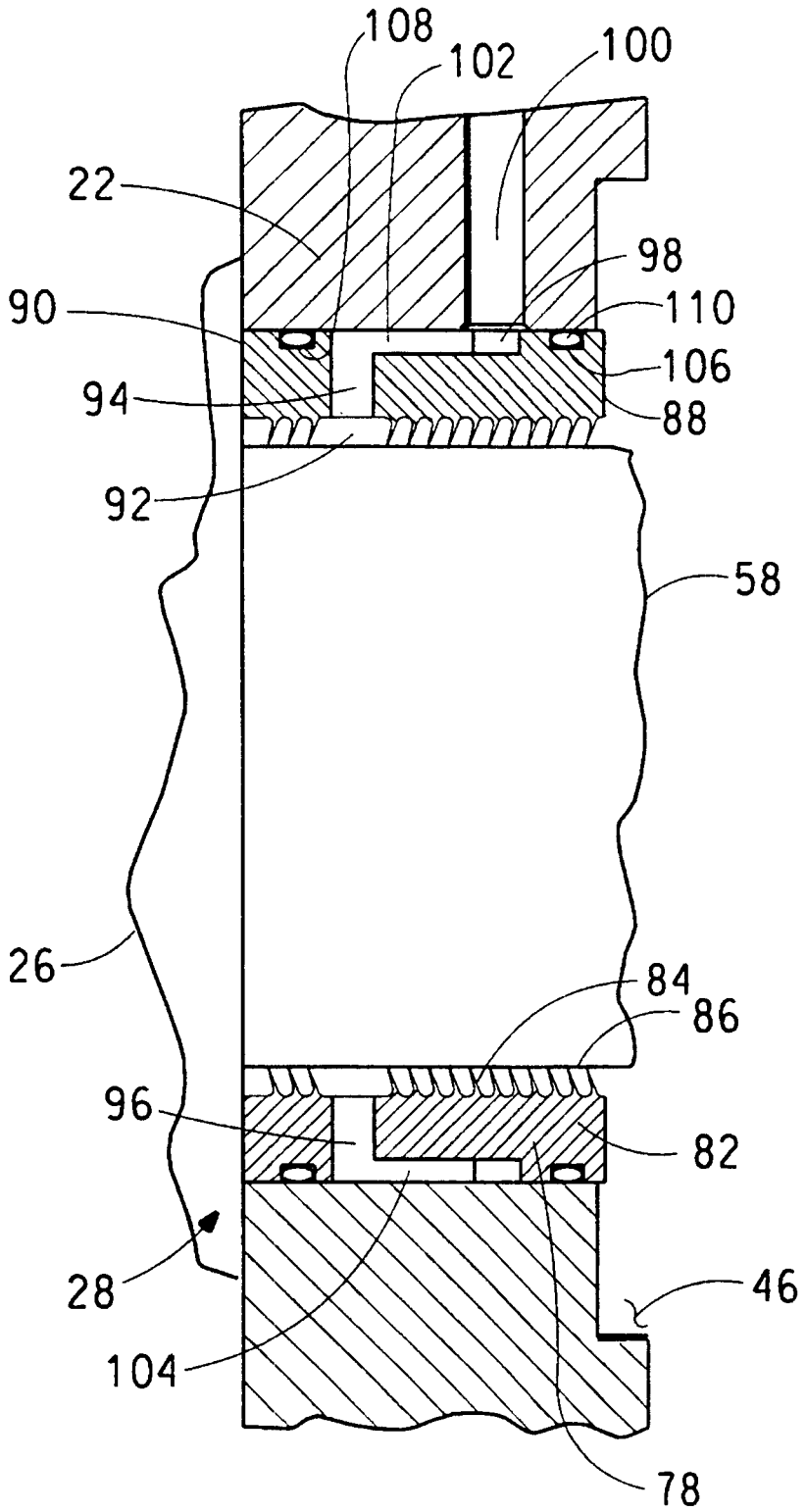
FIG. 3 shows an enlarged view of one of the labyrinth seals of FIG. 2.

FIG. 3 shows an enlarged view of the labyrinth seal 78 around shaft 58 which is typical of the other labyrinth seals. It comprises a hollow cylindrical body 82 and a plurality of circular ribs 84 forming an inner bore 86. The ribs are angled toward the working chamber 28 in which male rotor 24 resides. The ribs 84 are distributed evenly from a bearing chamber end 88 of the seal 78 to a working chamber end 90 of the seal. Intermediate to the ends 88 and 90 is a circumferential groove 92 where one of the ribs is omitted. There are a plurality of radially oriented holes, such as holes 94 and 96 extending from groove 92 through the body 82. On the outer cylindrical surface of body 82 is a circumferential groove 98 that is axially aligned with a passage 100 in the housing 22. Extending from groove 98 to each of the plurality of holes, such as holes 94 and 96, are axially oriented slots, such as slot 102 connecting to hole 94 and slot 104 connecting to hole 96. Also on the outer cylindrical surface of body 82 are two o-ring grooves, groove 106 adjacent end 88 and groove 108 adjacent end 90. These are designed to hold o-rings, such as o-ring 110, that cooperate with the housing 22 to seal groove 98 from the working chamber 28 and bearing chamber 46. Other types of seals, such as a close fitting straight bore seal without ribs, may also be used in the invention, although labyrinth seals are preferred. It is believed the labyrinth seals do a better job of preventing wicking of oil through the seals along the rotor shafts, since the buffer gas velocity flowing along a shaft is increased as it passes each rib in the seal. The high velocity stops the advance of oil along a shaft.

Referring to FIG. 2, there are a plurality of fluid passages in housing 22 to direct oil to the bearings and gears and to direct a buffer gas to the seals. Passage 112 directs fresh filtered oil to the gears 54 and 56, and to bearings 50 and 60 in chamber 44. Passage, 114 directs fresh filtered oil to the bearings 52 and 64 in chamber 44. Passage 116 directs fresh filtered oil to the bearings 66*a* and 66*b* in chamber 46. Passage 118 directs fresh filtered oil to the bearings 68*a* and 68*b* in chamber 48. Passage 120 directs a buffer gas to seal 74 and passage 122 directs a buffer gas to seal 76. Part of the buffer gas from seals 74 and 76 leaks to the working chamber 28 and part of it leaks to chamber 44. Passage 100 directs buffer gas to seal 78 and passage 124 directs buffer gas to seal 80. Part of the buffer gas from seal 78 leaks to the working chamber 28 and part of it leaks to chamber 46. Part of the buffer gas from seal 80 leaks to the working chamber 28 and part of it leaks to chamber 48. Passage 126 directs a large percentage of the buffer gas from the portion of chamber 46 between seal 78 and bearing 66*a* to a location outside of the housing 22. This has the purpose of bleeding off the buffer gas so it does not have to pass through bearings 66*a* and 66*b* before it can be removed from chamber 46. Similarly, passage 128 directs a large percentage of the buffer gas from the portion of chamber 48 between seal 80 and bearing 68*a* to a location outside of the housing 22. Passage 130 directs oil and some buffer gas from chamber 46 to a location outside of housing 22. Passage 132 directs oil and some buffer gas from chamber 48 to a location outside of housing 22. Passage 134 directs oil and buffer gas from chamber 44 to a location outside of housing 22.

Figure 4:
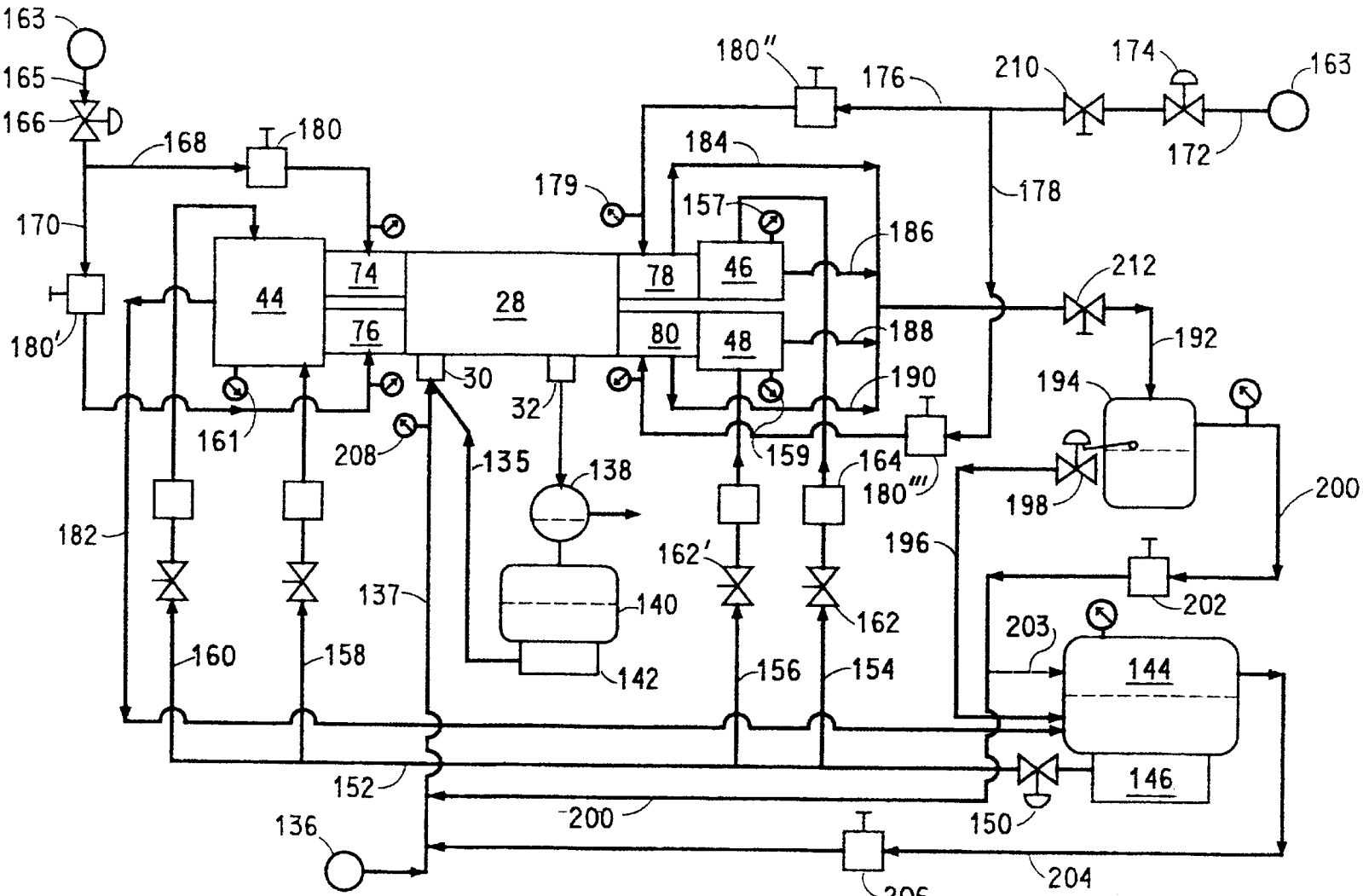
FIG. 4 shows a fluid schematic for the fluids provided to the working chamber, the bearing chambers, and the seals.

Reference is now made to FIG. 4 to describe the oil and buffer gas system. For ease of understanding the principle of operation of the system, some typical pressures and flows are illustrated in the figure, but it is understood that these values are not limiting to the invention and will be different for different applications. The process gas is shown entering the working chamber through inlet 30 at a pressure of about 2–3 psi from a process gas source 136 through an inlet line 137. The process gas is compressed in the working chamber 28 to a pressure of about 100 psi and is discharged through outlet 32. This maximum pressure is achieved at the ends of the lobes on the male and female rotors that are passing by the triangular shaped opening 72 (FIG. 2) in the side of chamber 28. The pressure at other lobes at that instant is somewhat lower and so the average pressure around each rotor shaft will be somewhat lower. In this case of a flooded screw compressor, a lubricant may be injected into the inlet 30 via line 137 (or it may be injected directly into the working chamber 28), and the process gas and lubricant may pass through as oil separator 138 that also serves as an oil reservoir. Oil from the separator may be collected in a reservoir 140 and pumped by pump unit 142 back to the inlet to be reused. The pump unit 142 may include such accessories as a filter, cooler, pressure regulator and the like.

To provide oil to bearings on both the low pressure inlet side of the compressor and the high pressure outlet side, a first oil reservoir 144 separator from reservoir 140 is provided with a pump unit 146 which includes a pressure regulator 150. This first oil reservoir may also serve as an oil/gas separator when oil and gas are fed into it. The pump unit 146 may include such accessories as a filter, cooler, and the like. Leading off of a main pressurized oil line 152, are branch line 154, 156 to the high pressure side, and branch lines 158 and 160 to the low pressure side. Referencing FIG. 2 (showing the passages) and FIG. 4, branch line 154 would be connected to passage 116 in housing 22 (FIG. 2); line 156 to passage 118; line 158 to passage 114; and line 160 to passage 112. Each branch line, such as line 154, contains a needle valve, such as valve 162, and a flow indicator, such as indicator 164, to control the flow between the high pressure of the main line and the pressure of the relevant bearing chamber; chamber 46 for line 154, chamber 48 for line 156, and chamber 44 for lines 158 and 160. On the low pressure side of the compressor, the pressure in the bearing and gear chamber 44 would be controlled to be about the same as the inlet pressure of the working chamber 28, or about 3 psi. In a preferred embodiment, the pressure in the bearing and gear chamber 44 would be controlled to be at least 90% of the inlet pressure of the working chamber 28. This could be monitored by a gage 161 in fluid communication with bearing chamber 44. On the high pressure side of the compressor, the pressure in the bearing chambers 46 and 48 would be controlled to be about the same as the average pressure around the rotor shafts at the outlet end 70 (see FIG. 2) of the working chamber, or about 65 psi for a 100 psi maximum outlet pressure. This could be monitored by a gage 157 in fluid communication with bearing chamber 46 and by a gage 159 in fluid communication with bearing chamber 48. The flow rates for the oil in the branch lines to the bearings would be about 0.8 gpm. By keeping the pressure of the oil in the bearing chambers to a level about equal to the pressure of the process fluid at each end of the working chamber, there is little or no driving force to encourage mixing of the bearing oil and process fluid (and any lubricant in the working chamber).

To provide a buffer gas for all the seals for each of the low pressure side and high pressure side of the compressor, two buffer gas main supply lines are provided from a single source of buffer gas 163, such as air or nitrogen or the like. A low pressure main supply line 165 is provided with a low pressure regulator 166 that provides a pressure of about 100 psi at 7 standard cubic feet per minute (scfm) that feeds two branch lines 168 and 170. A high pressure main supply line 172 is provided with a high pressure regulator 174 that provides a pressure of about 105 psi at 10 scfm that feeds two branch lines 176 and 178. Each branch line, such as line 168, has a rotometer, such as rotometer 180 that includes a needle valve and flow indicator to control the flow between the pressure of the relevant main line and the pressure of the relevant bearing chamber; chamber 44 for lines 168 and 170, chamber 46 for line 176, and chamber 48 for line 178. The buffer gas pressure developed in each seal should be slightly above the pressure in both the working chamber end and the bearing chambers that are adjacent to the ends of each seal. Ideally, the "seal pressure" would be that in the groove 92 (FIG. 3). However, practically speaking, this seal pressure would be about the same as the pressure at the beginning of the passage feeding buffer gas to the seal, such as, referring to FIG. 2, the entrance 101 where passage 100 enters the housing 22. Referring now to FIG. 4, a gage, such as gage 179, could be conveniently installed here to monitor seal pressure. The pressure drop axially in the seal from the groove 92 (FIG. 3) to the working chamber or to the bearing chamber would be typically 3–10 psi depending on such well known factors as the gas flow rate, number of ribs, the fit of the ribs to the rotor shaft, the seal and shaft diameters, and other such factors. The flow rate into the passage 100 (FIG. 2) is also a good indicator of sufficient elevated pressure and may be used to gage the proper operation of the system. If the pressure is too low, there will be no flow through the rotometer; if the pressure is too high, excessive flow will be present that is wasteful of buffer gas. A flow of 3–5 scfm into a seal is sufficient for proper operation of the seals. As mentioned referring to the oil system, on the low pressure side of the compressor, the pressure in the bearing and gear chamber 44 would be controlled to be about the same as the inlet pressure of the working chamber 28, or about 3 psi. In a preferred embodiment, the bearing and gear chamber pressure would be controlled to be at least 90% of the inlet pressure of the working chamber. The flow rate to each of seals 74 and 76 would be about 2–3 scfm at a seal pressure believed to be about 5 psi above the working chamber inlet pressure, or about 8 psi. On the high pressure side of the compressor, the pressure in the bearing chambers 46 and 48 would be about the same as the average pressure around the rotor shafts at the outlet end 70 (FIG. 2) of the working chamber, or about 65 psi for a 100 psi maximum outlet pressure, for example. In a preferred embodiment the bearing chamber pressure would be controlled to be at least 90% of the average pressure at the outlet end of the working chamber. The flow rate to each of seals 78 and 80 would be about 4–5 scfm at a seal pressure believed to be about 7 psi above the working chamber average outlet pressure, or about 72 psi. Referencing FIG. 2 (showing the passages) and FIG. 4, branch line 168 would be connected to passage 120 in housing 22 (FIG. 2); line 170 to passage 122; line 176 to passage 100; and line 178 to passage 124.

Since the seals are a labyrinth type (although other seals may be used in the present invention), some leakage of the buffer gas will occur. Referring to FIG. 3, the buffer gas for typical seal 78 is directed through passage 100 to groove 98, along slot 102 to holes 94 and 96 to circumferential groove 92 which is intermediate the ends of the seal body 82. Since the buffer gas is, thereby, introduced intermediate the ends of the seal body 82, a first portion of the flow to each seal will go toward the relevant bearing chamber and the remaining second portion will go toward the working chamber. In FIG. 3, the seal shown has the passage 92 off center with three (3) ribs on the working chamber side and eleven (11) ribs on the bearing chamber side. It is believed this will provide a higher flow of buffer gas toward the working chamber which will work better than a balanced flow to keep corrosive process fluid from entering the seal and getting to the bearings. In bearing chamber 44, a return line 182 returns the oil and buffer gas from chamber 44 to the first reservoir 144. Line 182 is a gravity return line and must be sloped downward to the first reservoir since the pressures in the chamber 44 and the first reservoir 144 are about the same. In bearing chamber 46, return line 184 carries most of the buffer gas introduced by line 176 out of housing 22 (FIG. 2), and return line 186 carries the oil introduced by line 154 and some buffer gas introduced by line 176. In bearing chamber 48, return line 188 carries the oil introduced by line 156 and some buffer gas introduced by line 178 out of housing 22 (FIG. 2), and return line 190 carries most of the buffer gas introduced by line 178 out of the housing. Outside housing 22, return lines 184, 186, 188, and 190 are manifolded together and join main return line 192 which carries the oil and some buffer gas to a second reservoir 194 (which also serves as an oil/gas separator which is maintained at about the same pressure as the bearing chambers 46 and 48. Return line 192 is a gravity return line and must be sloped downward to the second reservoir 194. In the second reservoir, the buffer gas and oil are separated and the oil is returned to the first reservoir 144 via line 196 and through a float valve 198 that lets down the oil pressure and keeps the oil level in the second reservoir at a constant level. The buffer gas is removed from the second reservoir via line 200 and the pressure is let down through a rotometer 202 at a rate of about 5 scfm (for the seal conditions discussed) before the gas is directed to a waste handling system or returned to the inlet side of the compressor at line 137 and blended with the process gas. The buffer gas removed from the second reservoir may alternatively enter the first reservoir and enter the head-space of first reservoir 144 following dashed line 203 that may create a cost savings on piping. The needle valve which is a part of the rotometer 202 is the primary element which controls the back pressure in the second reservoir 194 which controls the pressure in bearing chambers 46 and 48. Any buffer gas forced into solution in the oil under the high pressure can "boil off" under the low pressure in first reservoir 144. The buffer gas is removed from first reservoir 144 via discharge line 204 controlled by rotometer 206 at a rate of about 3 scfm (for the seal conditions discussed). The needle valve which is a part of the rotometer 206 is the primary element which controls the back pressure in the first reservoir 144 which controls the pressure in bearing chamber 44. The buffer gas so discharged via line 204 may be directed to a waste handling system, or as in the case shown, returned to the inlet side of the compressor at line 137 and blended with the process gas. It is preferred not to reuse the buffer gas and reintroduce it to the buffer gas source because the compressor for the buffer gas source may be remotely located and the expense of returning the low pressure gas to it is not worth the savings that might be available.

It is important in operating the system from a pressure standpoint to determine the preferred operating pressures. On the low pressure side, it is simple to determine the pressure level at the low pressure inlet end of the compressor by placing a gage 208 (FIG. 4) at the inlet of the working chamber. It is assumed that the pressure around the rotor shafts at the end 90 (FIG. 3) of the seals 74 and 76 will be about the same as this pressure. The rotometers 180 and 180' for the buffer gas to each low pressure seal 74 and 76 can be set to provide a low flow of gas to the seals and the rotometer 206 adjusted to provide a pressure to the first bearing chamber 44 at least equal to about 90% of the pressure measured at the inlet end of the working chamber 28. In a preferred embodiment, this low bearing chamber pressure may also be about the same as the working chamber pressure at the inlet end or may be greater than that pressure by as much as 30%. If the bearing chamber pressure is too much greater, excessive buffer gas flow will be required to prevent forcing bearing oil into the working chamber. With high buffer gas flow it is believed that atomization of the oil may occur and bearing oil may be carried out in the buffer gas waste stream in line 204. This can be determined by monitoring the oil level in the reservoir 144, which should remain constant. The seal pressure is always greater than the bearing chamber pressure to insure positive flow of buffer gas into the bearing chamber to keep bearing chamber oil out of the seal. The seal pressure will simply be that which is required to provide the desired positive seal flow at the selected bearing chamber pressure; the seal flow is the important parameter in determining the upper seal pressure limit.

On the high pressure side of the working chamber, since the average high pressure around the rotor shafts and seals is difficult to measure, means other than direct measurement in the working chamber may be employed to determine the initial pressures to begin operation. For instance, the line 172 from the buffer gas source can be blocked off with a shut off valve 210, and the line 192 blocked off with a shutoff valve 212, and lines 154 and 156 shut off at the valves 162 and 162'. The compressor can then be operated briefly to allow the working chamber pressure to "dead-head" through seals 78 and 80 into the bearing chambers 46 and 48 (respectively) without any appreciable flow through the seals. The pressure in the bearing chambers 46 and 48 as seen on gages 157 and 159, respectively, will be equal to the average high working chamber pressure. This pressure value can be used to set up the pressure in second reservoir 194.

This high bearing chamber pressure and second reservoir pressure may also preferably be about the same as the average working chamber pressure at the high pressure outlet end, or may be greater than that pressure by as much as 30%. As stated with reference to the low pressure, operation at too high a bearing chamber pressure may result in loss of oil in the reservoir. Some important considerations for evaluation of the operating conditions are:

1) The oil level in first reservoir 144 should remain essentially constant over time and if a flooded screw compressor is used, the oil level in reservoir 140 should also remain essentially constant over time.
2) The flow rate to seals 74, 76, 78, and 80 should remain at an acceptable low limit that does not waste buffer gas and does not create conditions where excess atomization of oil may occur that will result in oil loss from first reservoir 144.
3) There should not be any appreciable migration of corrosive process fluids into the bearing oil system that would show up as a build-up of contaminants in the bearing oil.

The operation of the system has been discussed referring to pressures to set up and control the system. Since flow rates and pressures are related, the use of flow rates can also be used to describe the invention and operation of the system. For instance, without knowing exactly what the pressures in the system are, the system can be set up using flow rates and operated successfully. For example, with the compressor running, the buffer gas flow to seals 74 and 76 can be set to 3 scfm each by rotometers 180 and 180' (for a total of 6 scfm). The flow out of bearing chamber 44 and first reservoir 144 would be set to 3 scfm by rotometer 206. This will cause a pressure to build up in bearing chamber 44 that will force 1.5 scfm of buffer gas from each seal (3 scfm total) to go into the low pressure inlet end of working chamber 28. This would provide a proper balance of buffer gas flow out of the seals 74 and 76 and a proper pressure in low pressure bearing chamber 44 to prevent mixing of process fluid and bearing oil. At the high pressure end of the compressor, the buffer gas flow to seals 78 and 80 can be set to 5 scfm each by rotometers 180" and 180'" (for a total of 10 scfm). The flow out of bearing chambers 46 and 48 and second reservoir 194 would be set to 5 scfm by rotometer 206. This will cause a pressure to build up in bearing chambers 46 and 48 that will force 2.5 scfm of buffer gas from each seal (5 scfm total) to go into the high pressure outlet end of working chamber 28. This would provide a proper balance of buffer gas flow out of the seals 78 and 80 and a proper pressure in bearing chambers 46 and 48 to prevent mixing of process fluid and bearing oil. In this discussion of controlling the system by flow rates, the flow to each seal is divided up into two portions with a first portion going to the bearing chamber and a second portion going to the working chamber. To maintain the proper conditions in the bearing chambers, the buffer gas leaving a bearing chamber is controlled to be less than the total of the buffer gas going into the seals for that bearing chamber. This will force a portion of buffer gas in the seals for that bearing chamber to go to the working chamber.

It is anticipated that the pressures and flows in the system are manually set at initial operation of the system, and the system will maintain a stable operation. If it is known that fluctuations in pressures and flows will be a possibility, it may be desirable to automate the control of the pressures and flows. This may be achieved by automated monitoring of the pressure in the bearing chamber 44 or first reservoir 144 for low pressures; and monitoring of the pressure in the bearing chambers 46 and 48 or second reservoir 194 for high pressures, and comparing these to desired values. If adjustments are required when the monitored pressures deviate, automated control of rotometer 202 can control the high pressure and automated control of rotometer 206 can control the low pressure. Alternatively, automated monitoring of the buffer gas flow to the seals and control of the seal rotometers, such as rotometer 180 may be desired, and automated monitoring of buffer gas flows from the first and second reservoirs 144 and 194, and control of rotometers 202 and 206 would be required to maintain specified flow values during process fluctuations. Known industrial computer control systems would be applicable to such automated feedback control.

The system described provides a process and apparatus for lubricating and sealing the bearings and gears associated with a plurality of rotors of a screw compressor and separating a process fluid to be compressed from the bearing and gear lubricant to avoid contact with a process fluid that would be corrosive to the bearings and gears. It is preferred to apply the system to a flooded screw type compressor because it is believed the oil in the working chamber is present to some extent in the working chamber end 90 of the seals which helps keep the buffer gas flow to a low level for a given seal pressure. This permits the use of a shorter seal than would be required in a dry screw type compressor using the same flow of buffer gas. A shorter seal permits a shorter rotor shaft, which permits a smaller diameter rotor shaft, which contributes to a lower cost compressor. Although the system was discussed referring to a screw compressor with only two rotors, the teachings of the invention would be applicable to compressors with more than two rotors, as are known in the art. Although the system illustrated had three bearing chambers, one low pressure and two high pressure, the illustrated compressor would work as well if there were only two bearing chambers (one low pressure and one high pressure) or four bearing chambers (two low pressure and two high pressure). Even more than four bearing chambers may be present if more than two rotors are present. In all cases, there will be a plurality of bearing chambers present, with at least one a low pressure bearing chamber (a first chamber), and at least one a high pressure bearing chamber (a second chamber).

It is, therefore, apparent that there has been provided in accordance with the present invention, a screw compressor method and apparatus for compressing process fluids in a working chamber that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method for lubricating and sealing bearings and gears associated with a plurality of rotors of a screw compressor and isolating a process fluid to be compressed from a lubricant for the bearings and gears, the screw compressor having the process fluid and the rotors in a working chamber, the rotors having shafts supported by the bearings, the bearings contained in a plurality of bearing chambers, the shafts passing from the working chamber to the bearings in the bearing chambers, the working chamber having a low pressure inlet end and a high pressure outlet end for the compressible fluid, comprising:

providing a low bearing chamber pressure to a first bearing chamber adjacent the low pressure inlet end of the working chamber, the low bearing chamber pressure at least equal to about 90% of the pressure at the low pressure inlet end of the working chamber;

providing a high bearing chamber pressure to a second bearing chamber adjacent the high pressure outlet end of the working chamber, the high bearing chamber pressure at least equal to about 90% of the average pressure at the high pressure outlet end of the working chamber;

pumping oil to the bearings in the plurality of bearing chambers under separate pressure;

sealing the first and second bearing chambers from the working chamber by seals having a bore around each rotor shaft, the seals comprising a body having a first end adjacent the working chamber and a second end adjacent a bearing chamber and an inner groove in the bore intermediate to the ends, the inner groove of each seal connected to a source of buffer gas;

providing a buffer gas to the seals adjacent the first bearing chamber, the buffer gas having a low pressure adjacent the groove greater than the low bearing chamber pressure, a portion of the low pressure buffer gas entering the first bearing chamber;

providing a buffer gas to the seals adjacent the second bearing chamber, the buffer gas having a high pressure adjacent the groove greater than the high bearing chamber pressure, a portion of the high pressure buffer gas entering the second bearing chamber;

releasing the oil in the first bearing chamber and the portion of the low pressure buffer gas from the first bearing chamber to maintain the low bearing chamber pressure wherein the oil in the first bearing chamber and the portion of the low pressure buffer gas are returned to a first reservoir for separation of the buffer gas from the oil; and releasing the oil in the second bearing chamber and the portion of the high pressure buffer gas from the second bearing chamber to maintain the high bearing chamber separate pressure, wherein the oil in the second bearing chamber and the portion of the high pressure buffer gas are returned to a second reservoir for separation of the buffer gas from the oil at the high bearing chamber pressure, and further returning oil to the first reservoir at the low bearing chamber pressure.

2. The method of claim 1, wherein providing a low bearing chamber pressure to a first bearing chamber comprises providing a low pressure buffer gas at a first predetermined flow rate to the seals adjacent the first bearing chamber, a first portion of the low pressure buffer gas entering the first bearing chamber and connecting the first bearing chamber to a first enclosed and pressurized oil reservoir at the low bearing chamber pressure; and wherein providing a high bearing chamber pressure to a second bearing chamber comprises providing a high pressure buffer gas at a second predetermined flow rate to the seals adjacent the second bearing chamber, a first portion of the high pressure buffer gas entering the second bearing chamber and connecting the second bearing chamber to a second enclosed and pressurized oil reservoir at the high bearing chamber pressure.

3. The method of claim 1, further comprising:

introducing oil into the working chamber so that the first end of the seals are exposed to the introduced oil.

4. The method of claim 1, wherein the seals for sealing the first and second bearing chambers from the working chamber comprises labyrinth seals, the labyrinth seals having labyrinth ribs positioned around each rotor shaft of the bore.

5. The method of claim 1, further comprising:

controlling the low chamber pressure in the first reservoir by controlling the release of buffer gas from the first reservoir; and controlling the high bearing chamber pressure in the second reservoir by controlling the release of buffer gas from the second reservoir.

6. The method of claim 5, further comprising: maintaining a constant level of oil in the second reservoir; and recirculating the oil returned to the first reservoir.

7. A method for lubricating and sealing the bearings and gears associated with a plurality of rotors of a screw compressor and isolating a process fluid to be compressed from a lubricant for the bearings and gears, the compressor having a process fluid and the rotors in a working chamber, the rotors having shafts supported by the bearings, the bearings contained in a plurality of bearing chambers, the shafts passing from the working chamber to the bearings in the bearing chambers, the working chamber having a low pressure inlet end and a high pressure outlet end for the compressible fluid, comprising:

providing a first bearing chamber adjacent the low pressure inlet end of the working chamber;

providing a second bearing chamber adjacent the high pressure outlet end of the working chamber;

pumping oil to the bearings in the plurality of bearing chambers under pressure;

sealing the first and second bearing chambers from the working chamber by seals having a bore around each rotor shaft, the seals comprising a body having a first end adjacent the working chamber and a second end adjacent a bearing chamber and an inner groove in the bore intermediate to the ends, the inner groove of each seal connected to a source of buffer gas;

providing a low pressure buffer gas at a first predetermined flow rate to the seals adjacent the first bearing chamber, a first portion of the low pressure buffer gas entering the first bearing chamber;

providing a high pressure buffer gas at a second predetermined flow rate to the seals adjacent the second bearing chamber, a first portion of the high pressure buffer gas entering the second bearing chamber;

releasing the oil in the first bearing chamber and the first portion of the low pressure buffer gas from the first bearing chamber and restricting the flow of released low pressure buffer gas to a rate less than the first predetermined rate to develop a low pressure in the first bearing chamber and force a second portion of low pressure buffer gas to enter the working chamber wherein releasing the oil in the first bearing chamber comprises passing the oil from the first bearing chamber and the first portion of the low pressure buffer gas to a first reservoir at the low bearing chamber pressure for separation of the buffer gas from the oil;

releasing the oil in the second bearing chamber and the first portion of the high pressure buffer gas from the second bearing chamber and restricting the flow of released high pressure buffer gas to a rate less than the second predetermined rate to develop a high pressure in the second bearing chamber and force a second portion of high pressure buffer gas to enter the working chamber wherein releasing the oil in the second bearing chamber comprises passing the oil from the second bearing chamber and the first portion of the high pressure buffer gas to a second reservoir for separation of the buffer gas from the oil at the high bearing chamber pressure, and then passing that oil to the first reservoir at the low bearing chamber pressure.

8. The method of claim 7, wherein restricting the flow of released low pressure buffer gas comprises controlling the flow of released low pressure buffer gas from the first reservoir; and restricting the flow of released high pressure buffer gas comprises controlling the flow of released high pressure buffer gas from the second reservoir.

9. The method of claim 7, wherein said seals for sealing the first and second bearing chambers from the working chamber comprise labyrinth seals, said labyrinth seals having labyrinth ribs positioned around each rotor shaft of said bore.

10. An apparatus for lubricating and sealing the bearings and gears associated with a plurality of rotors of a screw compressor and isolating a process fluid to be compressed from a lubricant for the bearings and gears, the compressor having the process fluid and the rotors in a working chamber, the rotors having shafts supported by the bearings, the bearings contained in a plurality of bearing chambers, the shafts passing from the working chamber to the bearings in the bearing chambers, the working chamber having a low pressure inlet end and a high pressure outlet end for the compressible fluid, comprising:

a first bearing chamber adjacent the low pressure inlet end of the working chamber;

means for providing a low bearing chamber pressure to the first bearing chamber, the low bearing chamber pressure at least equal to about 90% of the pressure at the low pressure inlet end of the working chamber;

a second bearing chamber adjacent the high pressure outlet end of the working chamber;

means for providing a high bearing chamber pressure to the second bearing chamber, the high bearing chamber pressure at least equal to about 90% of the average pressure at the high pressure outlet end of the working chamber;

a plurality of seals adjacent each bearing chamber and at each rotor shaft for sealing the first and second bearing chambers from the working chamber, the seals having a bore around each rotor shaft, the seals comprising:

a body having a first end adjacent the working chamber; and a second end adjacent a bearing chamber and an inner groove in the bore intermediate to the ends;

a source of pressurized buffer gas connected to the inner groove of each seal;

a first pressure control means between the source and the seals of the first bearing chamber to provide a low pressure buffer gas greater than the low bearing chamber pressure to the groove in the seals adjacent the first bearing chamber wherein a portion of low pressure buffer gas passes into the first bearing chamber;

a second pressure control means between the source and the seals adjacent the second bearing chamber to provide a high pressure buffer gas greater than the high bearing chamber pressure to the groove in the seals adjacent the second bearing chamber wherein a portion of high pressure buffer gas passes into the second bearing chamber; and a first reservoir connected to the first bearing chamber for separating a low pressure buffer gas from an oil and a second reservoir connected to the second bearing chamber, for separating a high pressure buffer gas from an oil.

11. The apparatus of claim 10, further comprising means to introduce oil into the working chamber so that the first end of the seals are exposed to the introduced oil.

12. The apparatus of claim 10, wherein the seals for sealing the first and second bearing chambers from the working chamber comprise labyrinth seals, the labyrinth seals having labyrinth ribs positioned around each rotor shaft of the bore.

13. The apparatus of claim 10, wherein the means for providing a low bearing pressure to the first bearing chamber comprises a valve connected to the first reservoir to release buffer gas from the first reservoir to control the pressure therein; and the means for providing a high bearing pressure to the second bearing chamber comprises a valve connected to the second reservoir to release buffer gas from the second reservoir to control the pressure therein.

14. The apparatus of claim 13, further comprising a float valve connected to the second reservoir to maintain a constant oil level in the second reservoir and to pass oil to the first reservoir, a pump connected to the first reservoir to pump oil to the bearings in the plurality of bearings chambers under pressure.

15. The apparatus of claim 14, further comprising means to introduce oil into the working chamber so that the first end of the seals are exposed to the introduced oil.

16. An apparatus for lubricating and sealing the bearings and gears associated with a plurality of rotors of a screw compressor and isolating a fluid to be compressed from the bearing and gear lubricant, the compressor having a process fluid and the rotors in a working chamber, the rotors having shafts supported by the bearings, the bearings contained in a plurality of bearing chambers, the shafts passing from the working chamber to the bearings in the bearing chambers, the working chamber having a low pressure inlet end and a high pressure outlet end for the compressible fluid, comprising:

a first bearing chamber adjacent the low pressure inlet end of the working chamber;

a second bearing chamber adjacent the high pressure outlet end of the working chamber;

a plurality of seals adjacent each bearing chamber and at each rotor shaft for sealing the first and second bearing chambers from the working chamber, the seals having a bore around each rotor shaft, the seals comprising a body having a first end adjacent the working chamber and a second end adjacent a bearing chamber and an inner groove in the bore intermediate to the ends;

a source of pressurized buffer gas connected to the inner groove of each seal;

a first flow control means between the source and the seals adjacent the first bearing chamber providing a predetermined flow of low pressure buffer gas to the groove adjacent the seals in the first bearing chamber wherein a portion of low pressure buffer gas passes into the first bearing chamber;

a second flow control means between the source and the seals adjacent the second bearing chamber to provide a predetermined flow of high pressure buffer gas to the groove adjacent the seals in the second bearing chamber wherein a portion of high pressure buffer gas passes into the second bearing chamber;

a third flow control means providing a flow of low pressure buffer gas from the first bearing chamber at a rate less than the predetermined flow of low pressure buffer gas;

a fourth flow control means providing a flow of high pressure buffer gas from the second bearing chamber at a rate less than the predetermined flow of high pressure buffer gas; and a first reservoir connected to the first bearing chamber for separating buffer gas and oil therein; and a second reservoir connected to the second bearing chamber for separating buffer gas and oil therein.

17. The apparatus of claim 16, wherein said seals for sealing the first and second bearing chambers from the working chamber comprise labyrinth seals, the labyrinth seals having labyrinth rib positioned around each rotor shaft of the bore.

18. The apparatus of claim 16, wherein the third flow control means comprises a valve connected to the first reservoir to release buffer gas from the first reservoir to control the flow of low pressure buffer gas; and the fourth flow control means comprises a valve connected to the second reservoir to release buffer gas from the second reservoir to control the flow of high pressure buffer gas.

19. The apparatus of claim 18, further comprising a float valve connected to the second reservoir to maintain a constant oil level in the second reservoir and to pass oil to the first reservoir; a pump connected to the first reservoir to pump oil to the bearings in the plurality of bearing chambers under pressure.

* * * * *